US005612768A

United States Patent [19]

Kim et al.

[11] Patent Number: 5,612,768

[45] Date of Patent: Mar. 18, 1997

[54] IMAGE FORMING APPARATUS WITH AN AIR VENTILATION STRUCTURE FOR PREVENTING CONTAMINATION OF CHARGING DEVICE

[75] Inventors: Dong-Joon Kim; Seong-Woo Kim, both of Suwon, Rep. of Korea

[73] Assignee: SamSung Electronics Co., Ltd., Suwon, Rep. of Korea

[21] Appl. No.: 558,273

[22] Filed: Nov. 13, 1995

[30] Foreign Application Priority Data

Nov. 12, 1994 [KR] Rep. of Korea ..... 29692/1994

[51] Int. Cl.[6] ..... G03G 21/00

[52] U.S. Cl. ..... 399/92; 355/30; 355/221; 355/210; 399/100; 399/114; 399/125

[58] Field of Search ..... 355/215, 30, 221–223, 355/225, 210

[56] References Cited

U.S. PATENT DOCUMENTS

| | | | |
|---|---|---|---|
| 3,332,328 | 7/1967 | Roth, Jr. . | |
| 3,936,184 | 2/1976 | Tanaka et al. . | |
| 4,154,521 | 5/1979 | Tanaka . | |
| 4,720,727 | 1/1988 | Yoshida . | |
| 5,021,831 | 6/1991 | Tonomoto | 355/215 |
| 5,028,959 | 7/1991 | Gooray | 355/215 |
| 5,038,170 | 8/1991 | Serita | 355/200 |
| 5,038,174 | 8/1991 | Kato et al. | 355/215 |
| 5,081,496 | 1/1992 | Takada . | |
| 5,128,110 | 7/1992 | Soga et al. | 355/215 X |
| 5,132,731 | 7/1992 | Oda | 355/215 |
| 5,164,778 | 11/1992 | Tanabe et al. | 355/215 |
| 5,185,629 | 2/1993 | Iino et al. | 355/215 |
| 5,189,473 | 2/1993 | Negoro et al. . | |
| 5,202,735 | 4/1993 | Thayer . | |
| 5,253,016 | 10/1993 | Behe et al. . | |
| 5,325,158 | 6/1994 | Guelfo et al. | 355/215 |
| 5,376,994 | 12/1994 | Mama et al. | 355/215 |
| 5,390,006 | 2/1995 | Wakabayashi et al. . | |
| 5,392,099 | 2/1995 | Kusumoto et al. . | |
| 5,416,572 | 5/1995 | Kolb et al. . | |
| 5,424,806 | 6/1995 | Siegel | 355/200 |
| 5,457,521 | 10/1995 | Makiura et al. | 355/215 |
| 5,471,280 | 11/1995 | Taguchi | 355/200 |
| 5,479,242 | 12/1995 | Sato et al. | 355/215 |

*Primary Examiner*—R. L. Moses
*Attorney, Agent, or Firm*—Robert E. Bushnell, Esq.

[57] ABSTRACT

An image forming apparatus having an air flow structure capable of generating an airflow along a direction substantially perpendicular to a photosensitive drum through a charging device in order to prevent contamination of a corona wire (i.e., discharge wire). The image forming apparatus constructed according to the principles of the present invention includes a main frame having parallel side walls with a side wall having an air intake port. A cover is pivotally connected at one end of said main frame so as to allow closing and opening of the image forming apparatus and an image carrier is installed in the main frame so as to form a latent image. A ventilation fan installed at the port in the side wall generates an air flow through an air duct installed to guide the air flow. A charging device positioned in parallel with the image carrier when the cover is closed so as to charge a surface of the image carrier for forming the latent image, includes a corona wire extending in a direction of the image carrier for performing charging operation in response to application of a voltage, and a shield case for protecting the corona wire and having at least one opening receiving air flowing from the duct and allowing the air to flow through the corona wire so as to prevent contamination of the wire.

20 Claims, 4 Drawing Sheets

IMAGE FORMING APPARATUS WITH AN AIR VENTILATION STRUCTURE FOR PREVENTING CONTAMINATION OF CHARGING DEVICE

CROSS-REFERENCE TO RELATED APPLICATIONS

This application makes reference to, incorporates the same herein, and claims all benefits accruing under 35 U.S.C. §119 from an application for Image Forming Apparatus Having A Device For Preventing Pollution of Charging Device earlier filed in the Korean Industrial Property Office on Nov. 12, 1995 and assigned Ser. No. 29692/1994.

BACKGROUND OF THE INVENTION

1. Technical Field

The present invention relates to an image forming apparatus including a charging device for charging an image forming carrier with a corona discharge generated by a corona wire, and particularly to a device for preventing pollution of a charging device by forming an airflow across the charging device.

2. Background Art

In an image forming apparatus such as, for example, printer, copier, facsimile machine or the like using an electrophotographic process, an electrostatic latent image formed on a photosensitive drum is developed by charging a surface of the photosensitive drum with a corona discharge and then applying toner on the photosensitive drum. The developed image is then transferred and fixed onto a recording medium such as a cut sheet of paper.

Generally, as a unit for charging the surface of the photosensitive drum, a corona discharging wire (i.e., charging wire) is used for the production of an uniform electric field in response to application of high voltage to charge the surface of the photosensitive drum with high potential for enabling the photosensitive drum to attract toner and thereby form the latent image. Such charging device not only discharges harmful ozone which causes image blurring and shading due to the degradation of the surface of the photosensitive drum, but also causes undesirable adhesion of fine dust particles to the corona wire because of the high electric field formed on the surface of the charging wire whenever the corona wire generates a high discharge current. The fine dust particles typically include flying toner which is the residue of toner left on the surface of the photosensitive drum after an image transfer operation that has not been cleaned by a cleaning unit, dust entered into the image forming apparatus, and paper powder flaking off the recording paper. Therefore, the surface of the corona wire becomes contaminated and this contamination of the corona wire tends to produce an uneven discharge that results in an unevenness in the developed image. Hence, it is necessary to frequency remove and manually clean the corona wire as well as the inside of the charging device.

Conventional designs for cleaning mechanisms such as represented, for example, by U.S. Pat. No. 5,392,099 for Image Forming Apparatus Having Cleaning Member For Cleaning Charging Wire issued to Kusumoto et al., endeavor to devise a cleaning pad arranged to slide along the corona wire in a main scanning direction in order to clean the corona wire. This cleaning technique however requires a costly cleaning mechanism constructed within the charging device.

Other designs prefer to use a contact type of charging unit instead of a corona discharge wire for the charging operation. For example, in U.S. Pat. No. 5,081,496 for Image Forming Apparatus Having A Ventilated Contact Charging Unit issued to Takeda employs a detachable process cartridge in which a charging roller as a contact charging member is disposed to charge the surface of the photosensitive drum in lieu of the corona discharge wire. Recognizing, however, that a contact charging roller tends to create an accumulation of discharge products at the side where the charging roller contacts the photosensitive drum, Takeda '496 proposes a ventilation system in a detachable process cartridge in which air flow is channeled to flow along a direction of a contact portion established between the contact charging roller and the photosensitive drum so as to remove the discharge products formed around the discharging roller.

While the conventional air ventilation system used in an image forming apparatus to avoid contamination may have differences in structure and functions such as, for example, U.S. Pat. No. 5,189,473 issued to Negoro et al., for removing toner particles leaking from a discharged toner container, and U.S. Pat. No. 5,390,006 for Imaging Forming Apparatus With Improved Exhaust Flow issued Wakabayashi et al., for handling toner and other debris between a fixing device and the photosensitive drum, it is our observation that no image forming device has been constructed to solve these particular problems related to the corona discharge wire. We have found that due to the high voltage applied to the corona wire and the concomitant high operating temperature of the corona wire, the corona wire is extremely susceptible to deleterious chemical reactions in the presence of ions accompanying the residual toner and other debris. Moreover, it is also our observation that no image forming device has been constructed in a manner in which the cost of the air ventilation system can be minimized while facilitating accessibility of the interior of image forming apparatus.

SUMMARY OF THE INVENTION

Accordingly, it is therefore an object of the present invention to provide an improved image forming device and process.

It is another object to provide an image forming apparatus and process for minimizing contamination of a corona wire of a charging device.

It is yet another object to provide an image forming apparatus and process for minimizing contamination of a charging device within the image forming apparatus by generating an air current and applying the air current to the charging device.

It is still another object to provide an image forming apparatus and process using air ventilation to reduce contamination of a corona wire of a charging device.

It is still yet another object to provide an image forming apparatus and process using air ventilation to regulate the temperature of a corona wire of a charging device after each charging operation.

It is a further object to provide an image forming apparatus in which a charging device is constructed with perforated openings allowing air to be drawn in a corona wire.

It is also an object to provide an image forming apparatus in which an air ventilation structure used to prevent contamination of a corona wire of a charging device is constructed to enhance accessibility to the interior of the image forming apparatus.

These and other objects may be achieved with an image forming apparatus constructed according to the principles of the present invention with an air ventilation structure having an air duct for guiding the air to flow through a charging device so as to prevent contamination of the discharging device. A main frame having parallel side walls and an air intake serves as a body. A cover is pivotally connected at one end of the main frame to allow closing and opening of the image forming apparatus. An image carrier such as a photosensitive drum is installed in the main frame to form a latent image. A charging device is detachably connected to the cover to be positioned in parallel with the image carrier, when the cover is closed to cover the main frame so as to charge a surface of the image carrier in order to form the latent image. The charging device includes a corona wire for performing charging operation in response to application of a voltage, and a shield case protecting the corona wire and having at least one perforated opening for drawing in air and allowing air to flow through the corona wire. A ventilation fan is installed on one side wall of the main frame to generate an air flow. The air duct as connected to the cover in a position so that when the cover is closed to cover the main frame, the air flow generated by the ventilation fan is guided from the air intake port at one side wall of the main frame through the opening of the charging device so as to minimize contamination of the discharging device.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
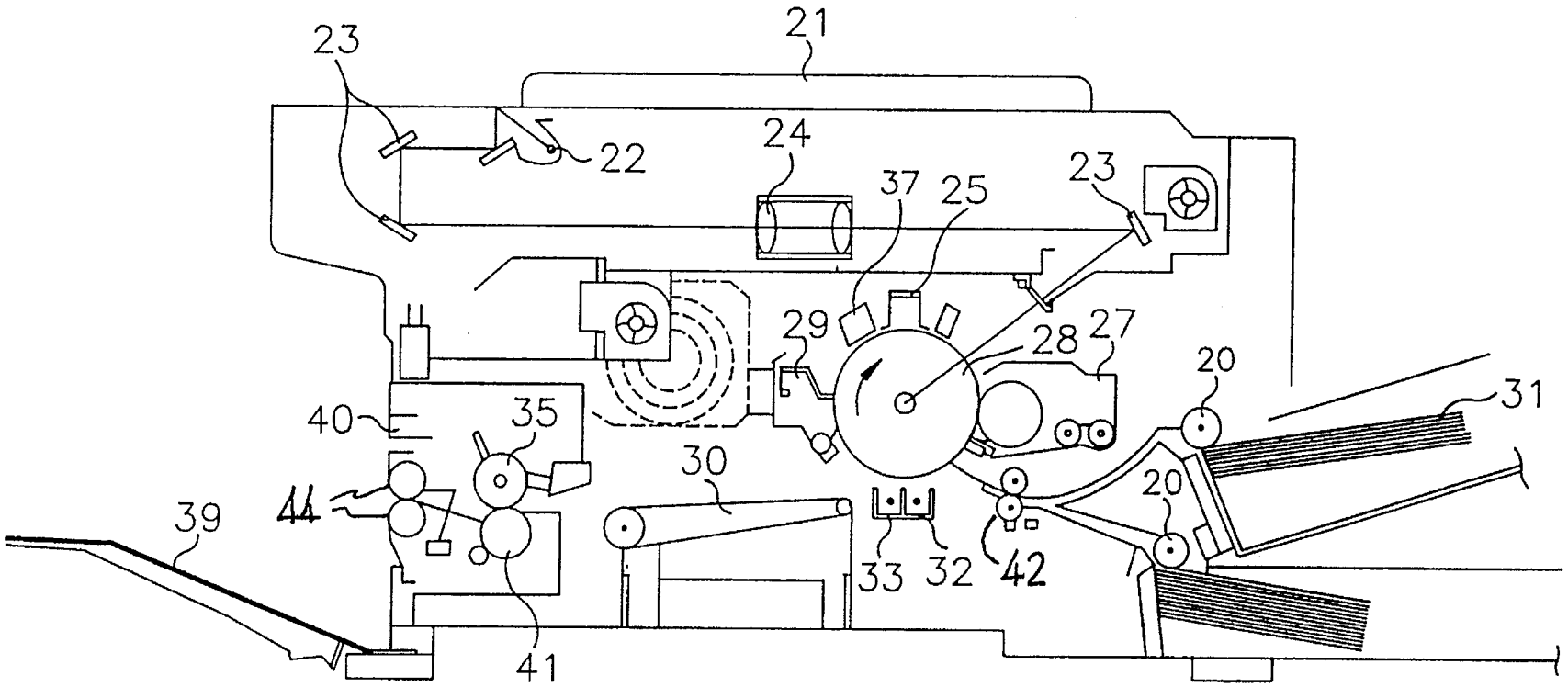
FIG. 1 is an abstract representation illustrating placement of salient components in a conventional image forming apparatus.

Referring now to the drawings and particularly to FIG. 1, which illustrates a conventional image forming apparatus, a typical image forming apparatus includes a document pad 21 in an upper portion; an optical assembly using a light source 22, reflecting mirrors 23 and an imaging lens 24; an imaging assembly constructed with a charging device 25, a developing unit 27, a photosensitive drum 28, a cleaning device 29, a transfer device 32, a separating device 33; a paper transport assembly having a pair of cassettes 46 each containing a record medium such as a stack 31 of cut sheet paper, a pair of feed rollers 20 and a pair of registration rollers 42 from an upstream side along a direction of transport of a sheet of the recording paper. The paper transport assembly also includes a transport belt 30, a pressure roller 34, a heating roller 35, a pair of discharge rollers 44, and a discharge tray 39 and the like so as to transport the recording paper separated from the photosensitive drum 28.

Typically, the surface of the photosensitive drum 28 is uniformly charged by corona discharge of a charging device 25, and an electrostatic latent image is formed on the surface of the photosensitive drum 28 by way of light irradiation from a light-emitting diode LED or a laser diode to a charged portion of the photosensitive drum 28, or using a light reflected from the recording paper disposed on a document pad 21 by the light source 22 of an exposure lamp 22. The electrostatic latent image is developed by toner while passing through the developing unit 27, and is then formed as a visual image. The visual image on the photosensitive drum 28 is transferred on the recording paper 31, which is fed from a selected one of the two cassettes 46 and into the image forming apparatus by one of the pair of feed rollers 20 by way of the transfer device 32.

Then, the recording paper is attached to the photosensitive drum 28 by an electrostatic force, and the separating device 33 serves to separate the attached copy paper from the photosensitive drum 28 to be transported by the transport belt 30 into the heating roller 35 and the pressure roller 34. There, the image of the document is fixed on the recording paper by the combination of heat and pressure, and thus the desired image forming operation is accomplished. After each image forming operation, however, residual toner and latent image remain on the photosensitive drum 28. The toner remaining on the photosensitive drum 28 is typically removed by a cleaning blade of the cleaning unit 29, and the latent image remaining on the photosensitive drum 28 is removed by a pre-erase lamp array 37.

Figure 2:
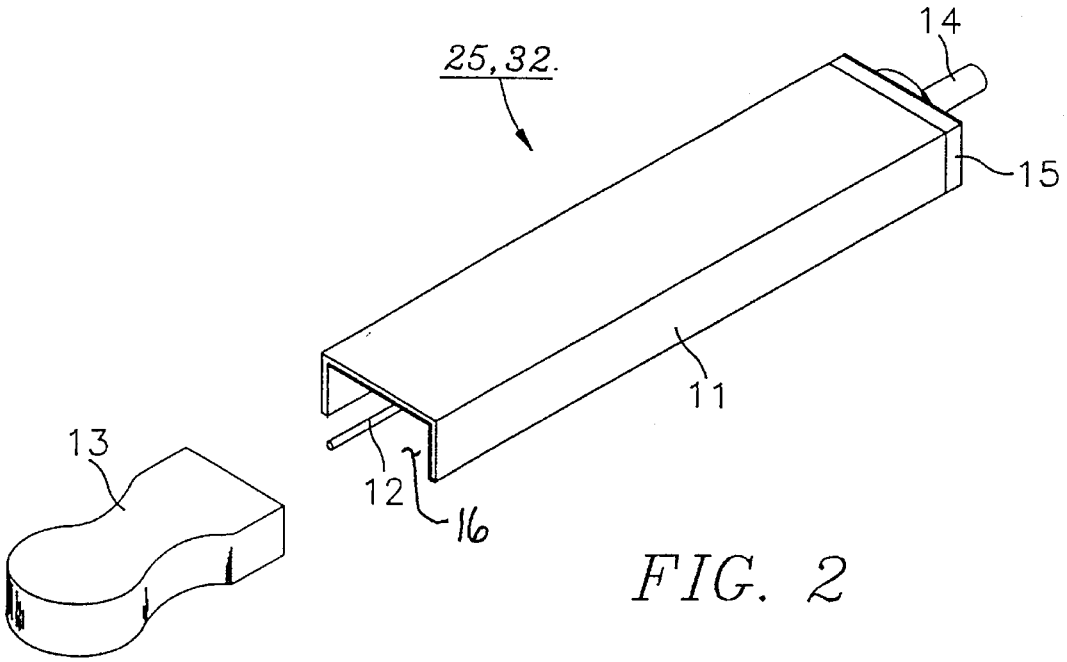
FIG. 2 illustrates a typical charging device usable in the conventional image forming apparatus of FIG. 1.

Since the corona discharge which has been widely used in the charging device 25 and transfer unit 32 as mentioned above is generated with a high voltage ranging from about several hundred to several thousand volts, the surface of the corona wire typical attracts extraneous particles which contributes to the deterioration of the quality and life of the charging device and the transfer unit using a corona wire. The corona discharge method is typically classified into corotron and scrotron types. In the charging device built with a shield case 11 and a corona wire 12 as shown in FIG. 2, the charging device 25 of the scrotron type has a corona wire 12 operated at a high negative voltage. By contrast, the charging device 25 of the corotron type operates with the corona wire 12 at a high positive voltage. The scrotron type typically exhibits a more uneven discharge characteristic than the corotron type.

In the image forming apparatus using an electrophotographic process of a reverse developing method, a scrotron type charging device is used. Accordingly, the surface of the photosensitive drum 28 is charged with a negative potential by the charging device 25 of the scrotron type. Hence, the charging device 25 applies a constant voltage (e.g., −550 V)

to a grid and the shield case of the charging device. A negative voltage of the several thousand volts is applied to the corona wire so as to produce corona discharge. Negative ions are actually discharged from the corona wire, and some of the discharged negative ions pass through the grid so as to charge the surface of the photosensitive drum 28 with about −600 Volts, while other ions flow via the grid and shield case. Then, the vicinity of the corona wire is a state sensitive to the reaction generated by the high pressure, high temperature and the presence of ions. Therefore, the corona wire can be easily deleteriously contaminated.

The charging device 25 as described in FIG. 1 has to uniformly charge the surface of the photosensitive drum with about −600 V, but an unevenly charged state is always generated with the scrotron type. Since the uneven charged state exists within the limit of several tens of volts for forming the image when the corona wire is clear, it is possible to form the image above a given level. If the corona wire is contaminated due to the continuous use however, since the uneven charged state exists with variations greater than several tens of volts, this has an adverse influence on the image formation.

FIG. 2 illustrates the typical charging device 25 for the corona discharge and the transfer unit 32 used in the conventional image forming apparatus. As shown in FIG. 2, a metallic shield case 11 surrounding the corona wire 12 only has an opening in a direction facing toward the photosensitive drum 28. A wire holder 15 is connected to one end of the shield case 11 where an electrode 14 for responding to application of high voltage power is installed, while a fixing holder 13 is connected to the opposite end of case 11. The corona wire 12 is disposed between the wire holder 15 and the fixing holder 13 in order to maintain a constant tensile force. Thus, when the current of a high voltage flows on the corona wire 12, the corona wire 12 produces the corona discharge. That is, if the current of the high voltage is applied to the corona wire 12 through the electrode 14 of the shield case 11, the corona discharge through the corona wire 12 is produced and the corona discharge is then used to charge the surface of the photosensitive drum 28 so that the toner which has adhered on the photosensitive drum 28 is transferred onto the recording paper 31.

As mentioned above, the conventional image forming apparatus experiences undesirable adhesion of extraneous particles to the corona wire because of high electric field formed on the surface of the charging wire when the corona wire generates a high discharge current for each image forming operation. This contaminates the corona wire and deleteriously reduces the corona discharge characteristics of the charging device.

Figure 3:
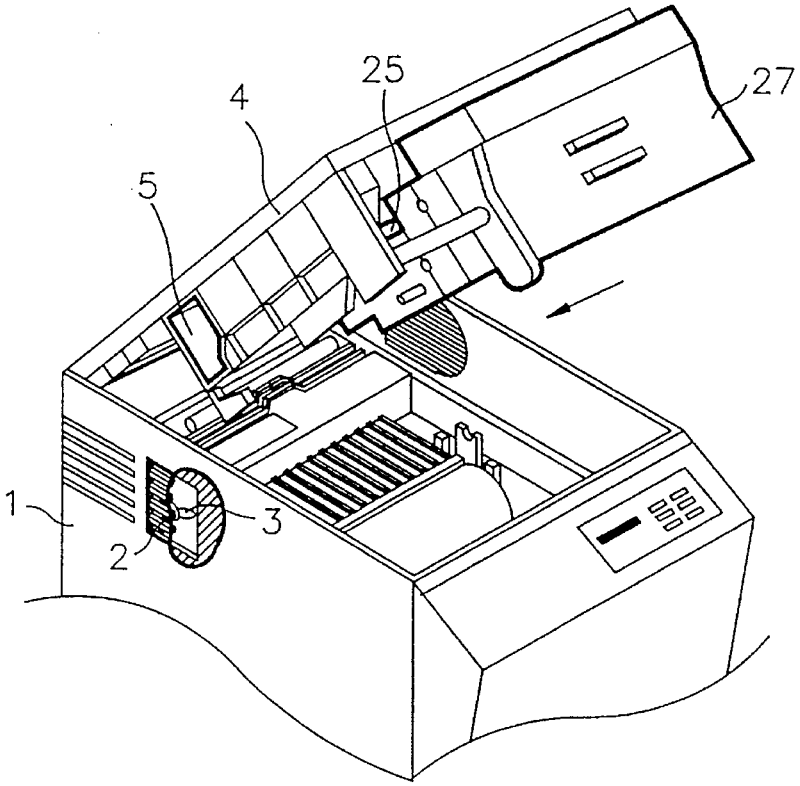
FIG. 3 is a perspective view of the image forming apparatus in which a device for preventing pollution of a charging device is installed according to the principles of present invention.
Figure 4:
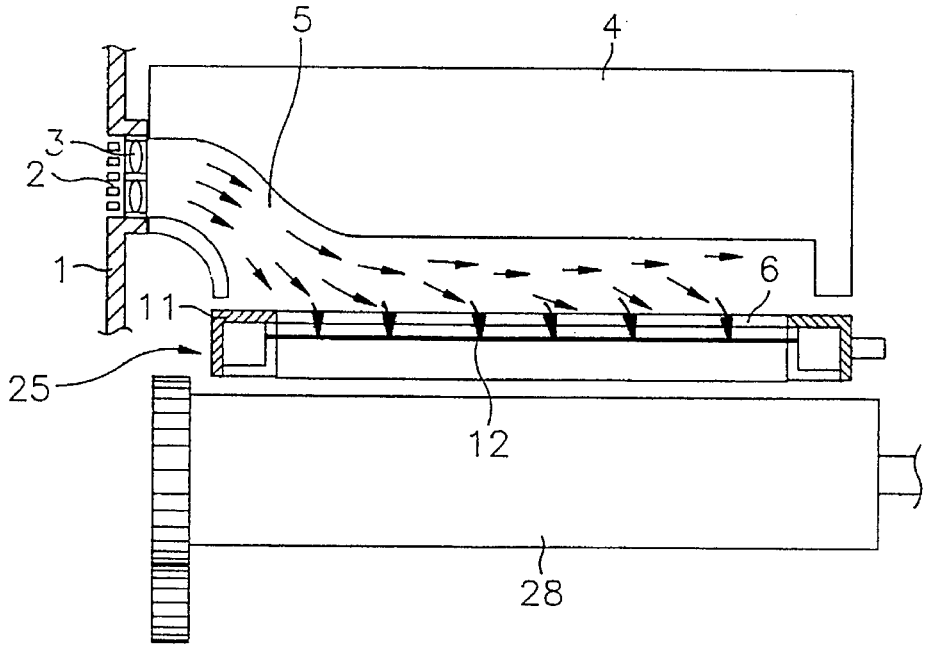
FIG. 4 is a perspective view illustrating the construction of an image forming apparatus in which the contamination of the charging device is avoided according to the principles of the present invention.

Turning now to FIG. 3 which illustrates an image forming apparatus in which a novel air ventilation structure is constructed to prevent contamination of a corona wire of a charging device in a manner that is simple, compact and replaceable. The air ventilation structure as constructed in the image forming apparatus constructed according to the principles of the present invention is now described with reference to FIGS. 3 through 5. An aperture, or port 2 for enabling air to flow into the image forming apparatus is formed on one side of a body 1. A ventilating fan 3 is installed at an inner side of port 2, and an air duct 5 into which the air can be induced is installed in one side of inner frame of the body 1. The air current generated by the ventilating fan 3 flows through an opening of the air duct 5. The air duct 5 is extended up to an upper portion of the charging device 25 which is positioned in front of the developing device 27 and installed in an upper portion of the photosensitive drum 28, and accordingly the air current generated in the ventilating fan 3 can be provided to the upper portion of the charging device 25 through the air duct 5. For the user'safety, it may be desirable to form the outer surface of the hole 2 in a mesh-like form.

Figure 5:
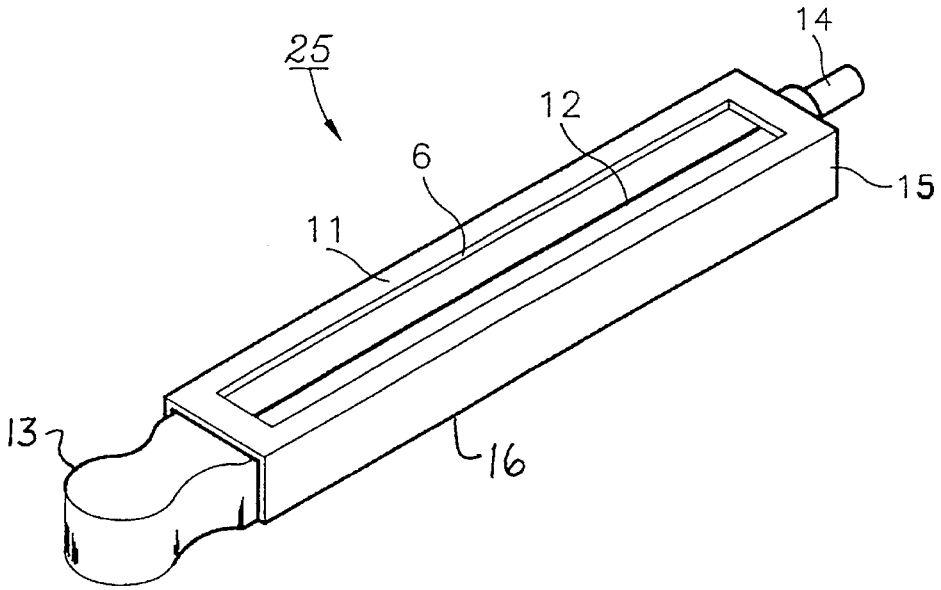
FIG. 5 is a perspective view of the charging device constructed according to the principles of the present invention.
Figure 6:
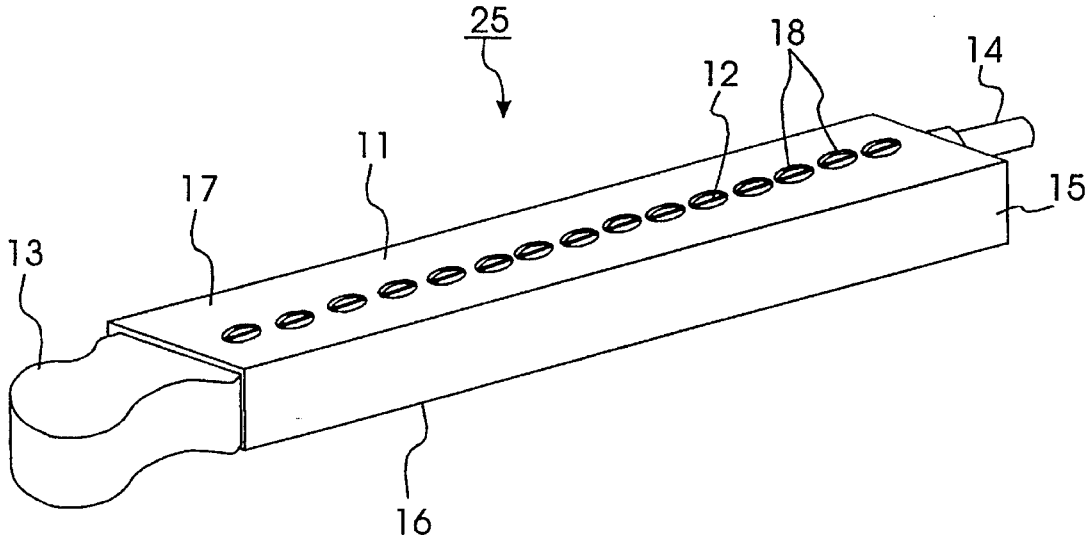
FIG. 6 is a perspective view of an alternative embodiment of a charging device constructed according to the principles of the present invention.
Figure 7:
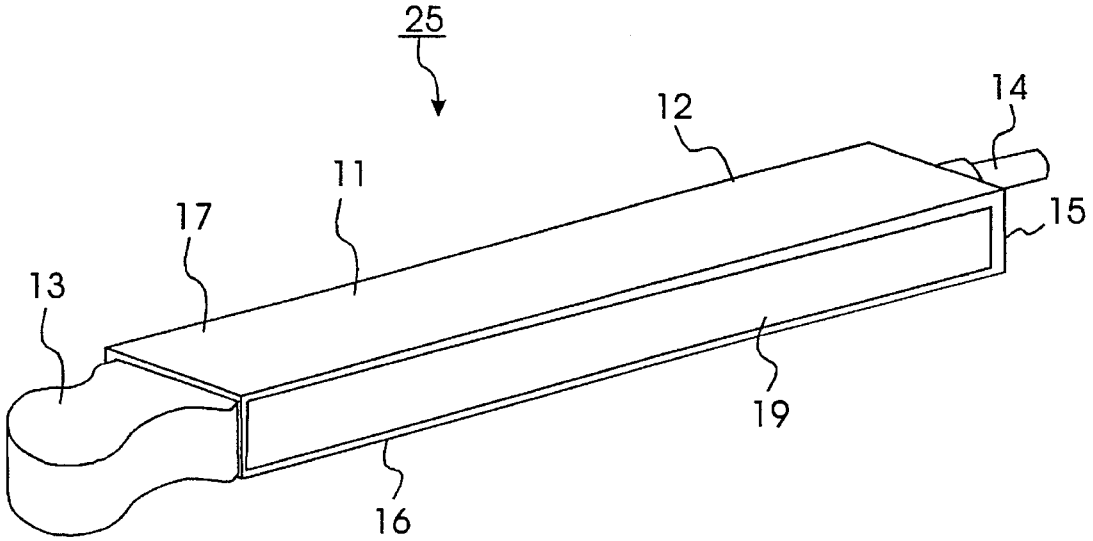
FIG. 7 is a perspective view of another alternative embodiment of a charging device constructed according to the principles of the present invention.

In charging device 25, the air current generated by the ventilating fan 3 is provided to the opening 6 through the air duct 5 formed in the upper portion of the shield case 11, and contamination of the corona wire 12 can be prevented by the air current. The underside 16 of shield case 11 is adjacent and open to expose corona wire 12 to the circumferential exterior surface of photosensitive drum 28. The opening 6 is formed in a rectangular shape on the upper side 17 of the shield case 11 opposite wire 12 from underside 16, as shown in FIG. 5. The opening 6 can alteratively be formed as a plurality of discrete, spaced-apart holes 18 as shown in FIG. 6, or can be formed as an opening 19 on the sides of the shield case 11 as shown in FIG. 7. Therefore, various modifications of the opening 6 can be made in order to facilitate the flow of the air current from duct through the charging device 25.

In the image forming apparatus, the inner frame 4 of the body 1 in the image forming apparatus is hinged to body 1 to enable frame 4 to be opened and shut, and the air duct 5 is installed to extend from one side of frame 4 substantially across the width of inner frame 4 to channel the flow of air introduced by fan 2 into duct 5 through opening 6 and across corona wire 12. The under surface 16 of shield case 16 extends axially along the exterior photosensitive surface of drum 28, with corona wire 12 in close proximity to that surface. Consequently, air flowing from duct 5 through opening 6 flows out of shield case 11 through the lowermost, or under surface 16 of shield case 11, in a direction substantially perpendicularly to the exterior circumferential photosensitive surface of drum 28 and in a circular arc partially around the exterior photosensitive surface of drum 28. The developing device 27 is detachably provided within the inner frame 4, and the charging device 25 is positioned in the front most portion of the inner frame 4. If the developing device 27 is provided within the inner frame 4, the opening 6 of the shield case 11 of the charging device 25, which is positioned at the front of the developing device 27, engages one side of the air duct 5. In this state, if the inner frame 4 is shut, the other side of the air duct 5 engages and receives a steady flow of outside, ambient air from the ventilating fan 3.

At this time, if the air current is generated by the ventilating fan 3 installed next to port 2 positioned in one side of the body 1, the generated air current flows into the charging device 25 through the opening 6 of the shield case 11 in the embodiment shown in FIG. 5. When the air current flows through the corona wire 12, the temperature of the corona wire 12, which otherwise has a high temperature and high ion density caused by the discharge due to the high voltage, is decreased and the resultant ion flows toward photosensitive drum 28 from the vicinity of the corona wire 12. Therefore, the ion density in the vicinity of the corona wire 12 is reduced, and at the same time, ions in a quantity sufficient to maintain the discharge flows toward charging device 25. As a result, the charging characteristic is uniformly maintained, and deterioration of the corona wire is minimized. Furthermore, there are advantages in that the life of the charging device 25 acting as an element limiting the life of the developing device and the image forming apparatus is lengthened, and accordingly the overall cost of the image forming apparatus can be reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming apparatus, comprising:

a main frame having an upper frame pivotally connected at one end of said main frame for enabling access into an interior of said image forming apparatus:

a process cartridge detachably mounted in said image forming apparatus, said process cartridge comprising a photosensitive drum and a charging device charging an exterior circumferential surface of said photosensitive drum with an electrical potential; air generating means installed in said main frame, for generating an air flow from an exterior air; and air guiding means positioned to guide the air flow generated by said air generating means to said charging device when said upper frame is closed to cover said main frame, said air guiding means comprising an air duct for supplying the air flow through said charging device and toward said photosensitive drum to prevent contamination of said charging device.

2. The image forming apparatus of claim 1, further comprised of said air generating means comprising a ventilation fan.

3. The image forming apparatus of claim 1, further comprised of said process cartridge detachably engaging said upper frame of the image forming device pivotally connected at one end of said main frame for allowing said air duct to guide the air flow through said charging device, when said upper frame is closed to cover said main frame.

4. The image forming apparatus of claim 1, further comprised of said air duct guiding the air to flow along a direction substantially perpendicular to the photosensitive drum through said charging device extending from a bottommost end.

5. The image forming apparatus of claim 1, further comprised of said charging device comprising a shield case having a plurality of discrete, spaced-apart openings formed therein, a corona wire connected to said shield case, and an electrode responding to voltage application to form an uniform electric field on the surface of the corona wire for enabling the photosensitive drum to form the latent image.

6. The image forming apparatus of claim 1, further comprised of said charging device comprising a shield case having an opening, and a corona wire connected to said shield case for performing charging operation in response to application of a voltage, and said air duct guiding the air flow to be drawn into and discharged therefrom the opening of said charging device to prevent contamination of the charging device.

7. An image forming apparatus, comprising:

a process cartridge detachably mounted in said image forming apparatus, said process cartridge comprising a photosensitive drum and a charging device installed so as to be adjacent to and to extend axially along an exterior circumferential surface of said photosensitive drum;

air generating means installed in a main frame of said image forming apparatus for generating an air flow from an exterior air; and air guiding means for providing said air flow generated in said air generating means to said charging device, an opening of said air guiding means meeting said air generating means and an outlet of said air guiding means being formed along a longitudinal direction of said charging device, and when said process cartridge is mounted in said image forming apparatus, said process cartridge aligning with said outlet of said air guiding means in position adjacent to said charging device along said longitudinal direction.

8. The image forming apparatus of claim 7, further comprised of said air generating means comprising a ventilation fan.

9. The image forming apparatus of claim 7, further comprised of said process cartridge being installed in an upper frame pivotally connected at one end of said main frame for allowing said air guiding means to guide the air flow through said charging device, when said upper frame is closed to cover said main frame.

10. The image forming apparatus of claim 7, further comprised of said air guiding means guiding the air to flow along a direction substantially perpendicular to the photosensitive drum through said charging device extending from a bottommost end.

11. The image forming apparatus of claim 7, further comprised of said charging device comprising a shield case having an opening, and a corona wire connected to said shield case for performing charging operation in response to application of a voltage, and said air duct guiding means guiding the air flow to be drawn into and discharged therefrom the opening of said shield case to prevent contamination of the charging device.

12. The image forming apparatus of claim 7, further comprised of said charging device comprising a shield case having a plurality of discrete, spaced-apart openings formed therein, a corona wire connected to said shield case, and an electrode responding to voltage application to form an uniform electric field on the surface of the corona wire for enabling the photosensitive drum to form the latent image, and further comprised of said air duct guiding means guiding the air flow to be drawn into and discharged therefrom the plurality of discrete, spaced-apart openings of said shield case to prevent contamination of the charging device.

13. An image forming apparatus, comprising:

a main frame including air current generating means installed thereon for generating an air current; and a process cartridge to be detachably mounted in said image forming apparatus, said process cartridge comprising:

a photosensitive drum;

a charging device for charging an outer circumferential surface of said photosensitive drum, said charging device having a charging wire and an elongated shield case, a first side of said elongated shield case being open and oriented to face toward and extend axially along the outer circumferential surface of said photosensitive drum, and said elongated shield case having an elongated opening formed in a second side for allowing the air current generated from said air current generating means to be drawn into, and discharged therefrom to prevent contamination of said charging device; and a housing for supporting said photosensitive drum and said charging device, said housing having an air guiding passage formed, when said process cartridge is mounted in said image forming apparatus, for guiding the air current generated from said air current generating means to flow through said charging device to prevent contamination of said charging device.

14. The image forming apparatus of claim 13, further comprised of said air current generating means comprising a ventilation fan installed at one side of said main frame of said image forming apparatus.

15. The image forming apparatus of claim 13, further comprised of said process cartridge being detachably installed in an upper frame pivotally connected at one end of said main frame of said image forming apparatus for enabling said air guiding passage to guide the air current through said charging device, when said upper frame is closed to cover said main frame to prevent contamination of said charging device.

16. The image forming apparatus of claim 13, further comprised of said air guiding passage being formed by an air duct for guiding the air current to flow along a direction substantially perpendicular to the photosensitive drum through said charging device.

17. The image forming apparatus of claim 13, further comprised of said process cartridge comprising:

a developing device for developing a latent image formed on said photosensitive drum to a toner image; and a cleaning device adapted for cleaning the outer circumferential surface of said photosensitive drum.

18. A process cartridge to be detachably mounted on an image forming apparatus having air current generating means for generating an air current, said process cartridge comprising::

a photosensitive drum;

a charging device having a charging wire extending spaced apart from said photosensitive drum along an axial direction of said photosensitive drum, for applying an electrical charge to said photosensitive drum, said charging device including a shield case protecting said charging wire and having at least one opening formed therein extending in an axial direction of said charging device and said photosensitive drum, and adapted to receive the air current generated from said air current generating means through said opening; and a housing for supporting said photosensitive drum and said charging device.

19. The process cartridge of claim 18, further comprised of said air current generating means comprising a ventilation fan installed at one side of a main frame of said image forming apparatus, and said housing comprising an air guiding passage formed, when said process cartridge detachably installed in an upper frame pivotally connected at one end of said main frame of said image forming apparatus, to guide the air current through said charging device, when said upper frame is closed to cover said main frame.

20. The process cartridge of claim 19, further comprised of said air guiding passage being formed by an air duct for guiding the air current to flow along a direction substantially perpendicular to the photosensitive drum through said charging device.

* * * * *